US009151141B1

(12) United States Patent
Ippolito

(10) Patent No.: US 9,151,141 B1
(45) Date of Patent: Oct. 6, 2015

(54) APPARATUS AND METHOD FOR MODIFYING LOADING IN A PUMP ACTUATION STRING IN A WELL HAVING A SUBSURFACE PUMP

(75) Inventor: Joe J. Ippolito, Bakersfield, CA (US)

(73) Assignee: LOTRAM LLC, Bakersfield, CA (US)

( * ) Notice: Subject to any disclaimer, the term of this patent is extended or adjusted under 35 U.S.C. 154(b) by 377 days.

(21) Appl. No.: 13/545,860

(22) Filed: Jul. 10, 2012

(51) Int. Cl.
*E21B 43/00* (2006.01)
*E21B 43/12* (2006.01)

(52) U.S. Cl.
CPC ..... *E21B 43/00* (2013.01); *E21B 43/121* (2013.01); *E21B 43/126* (2013.01)

(58) Field of Classification Search
USPC ..... 166/380, 105, 68, 73, 372
See application file for complete search history.

(56) References Cited

U.S. PATENT DOCUMENTS

| | | | | |
|---|---|---|---|---|
| 468,983 | A | 2/1892 | Stephans | |
| 1,729,737 | A | 10/1929 | Crawshaw | |
| 2,001,662 | A | 5/1935 | Bloss | |
| 2,112,254 | A | 4/1936 | Stokes | |
| 2,184,437 | A | 12/1939 | Saxe | |
| 2,233,226 | A | 2/1941 | Ramey | |
| 2,902,884 | A | 9/1959 | Blackburn | |
| 3,209,605 | A | 10/1965 | Scoggins | |
| 3,279,266 | A | 10/1966 | Dobbs | |
| 3,646,833 | A | 3/1972 | Watson | |
| 3,793,904 | A | 2/1974 | Grable | |
| 3,986,355 | A | 10/1976 | Klaeger | |
| 4,076,218 | A | 2/1978 | Gault | |
| 4,197,766 | A | 4/1980 | James | |
| 4,321,837 | A | 3/1982 | Grigsby | |
| 4,377,092 | A | 3/1983 | Garmong | |
| 4,406,122 | A | 9/1983 | McDuffie | |
| 4,601,640 | A | 7/1986 | Sommer | |
| 4,651,582 | A | 3/1987 | Bender | |
| 5,431,229 | A * | 7/1995 | Christensen | 166/369 |
| 5,749,416 | A * | 5/1998 | Belcher | 166/68.5 |
| 2006/0024177 | A1 | 2/2006 | Robison et al. | |
| 2011/0073317 | A1* | 3/2011 | Wilson | 166/369 |
| 2011/0162853 | A1* | 7/2011 | Kostrov et al. | 166/380 |

* cited by examiner

*Primary Examiner* — David Bagnell
*Assistant Examiner* — Taras P Bemko
(74) *Attorney, Agent, or Firm* — James M. Duncan, Esq.; Klein DeNatale Goldner

(57) ABSTRACT

A housing unit installed within a tubing string of a oil well, water well, or gas dewatering well contains at least one reciprocating plunger which utilizes the hydraulic head of the fluid in the tubing to modify the loading in a subsurface pump actuation string, such as a string of sucker rods. The device can be used to either reduce observed polished rod loads at the surface to reduce the required counterbalance, or the device can be used to provide additional loading in the pump actuation string above the pump to reduce buckling. The device is used in a method for modifying the loading in a subsurface pump actuation string.

15 Claims, 8 Drawing Sheets

APPARATUS AND METHOD FOR MODIFYING LOADING IN A PUMP ACTUATION STRING IN A WELL HAVING A SUBSURFACE PUMP

BACKGROUND OF THE INVENTION

This application relates to wells which use subsurface pumps to produce fluids from a subsurface reservoir to the surface, where the subsurface pump is actuated by an actuation string, such as a string of sucker rods or a string of small diameter tubing. Typically reservoir pressure declines over time and the wells require some form of artificial lift. This may be true for water wells as well as oil wells.

Sucker rod pumps are the most common form of artificial lift for oil wells. Sucker rod actuated pumps may be operated by reciprocation of the rod string, as with a rod pump having a plunger which seals within a barrel, drawing fluid into the barrel on the upstroke. The rod string is typically reciprocated up and down by a pumping unit at the surface. Another type of subsurface pump—the progressive cavity pump—is actuated by the rotation of the rod string, which rotates a rotor within a stator. In both cases, the rod string acts as a pump actuation string. While the typical installation utilizes a string of individual rods coupled in an end-to-end configuration, it is to be appreciated that other configurations of a pump actuation string may be utilized, such as a string of small diameter tubing joints connected together. In addition, because continuous lengths of tubing or rod are known, such as reeled tubing, etc, such a continuous single length may also be utilized as a pump actuation string.

Pumping units for rod pumped wells must be sized according to the loading induced on the pumping unit by the loading at the polished rod or top rod in the rod string. The sizing is further complicated for wells produced with reciprocating rod pumps because the loading varies as the rod string moves between the up stroke and the down stroke. During the up stroke, the polished rod lifts the fluid, rod string suspended from the polished rod, and the pump plunger. During the down stroke, the polished rod lowers the rods and pump plunger. Therefore the pumping unit would be fully loaded on the upstroke and lightly loaded on the down stroke. Compensation for this uneven loading is partially addressed by counter balance effects (CBE) which attempt to reduce equipment loading and balance the loading across the pumping cycle. In the ideal installation, the CBE would equal the rod weight plus one-half of the fluid load, that is the pumping unit would lift half the fluid on both the up and down stroke. The rod load would be eliminated by the ideal CBE.

The walking beam pumping unit is the most common sucker rod pumping system. These types of units convert rotational motion of the prime mover of the pumping unit into a generally vertical reciprocating motion of the polished rod. Typical pumping units have a horse head which is shaped such that the polished rod reciprocates vertically without a horizontal motion. Therefore the polished rod forces act vertically. This shape produces an increase in the effective length of the waking beam as the walking beam reaches the top and bottom of the stroke. Therefore the horizontal distance from the polished rod to the balance point remains constant. Polished rod torque, on the walking beam, is the product of the vertical force and the horizontal distance, therefore the torque is constant. However, for walking beam mounted counter-weights, the distance from the walking beam balance point to the counterbalancing weights is constant. In that gravity works vertically through the weights, the horizontal distance from the weights to the balance point is constantly changing.

Torque from the fixed point CBE is therefore at a minimum at the top of the stroke, a maximum in the middle, and a minimum again at the bottom. Therefore the torque from the chosen CBE will vary and only match at one position of the stroke. Counter-weights are typically placed to match the load in the middle of the stroke. The CBE mismatch increases as the walking beam angle is increased to obtain longer strokes.

As discussed above, the geometry of these units prohibits an ideal CBE throughout the entire stroke cycle, and an ideal CBE can only be realized at a few specific stoke positions. Consequently, the CBE is less than ideal at the other stroke positions. This limitation of the known methods for achieving CBE has required that the sizing of the various components of the pumping units, including walking beams, structural members, and gear boxes be sized for loading which occurs in the stroke positions where the ideal CBE cannot be achieved.

The known method of achieving CBE for walking beam pumping units is by utilizing counter-balance weights on either the walking beam opposite the polished rod or on the crank arms of the pumping unit. However, the mounting of weights on the walking beam greatly increases the load supported by the walking beam and its structure. This loading is compounded by the dynamics of stabilizing a large reciprocating mass at the end of the walking beam. These forces increase with longer strokes, rapid strokes, and larger loads. Therefore beam mounted counter-weights have been limited to the smallest of pumping units.

Crank mounted counter-weights have been utilized in an effort to overcome the above problems. However, while placing weights on the crank arms generally solves the dynamic load problems associated with the beam mounted weights, the crank mounted weights introduces a severe problem with matching CBE to polished rod load. Pumping units having crank mounted weights retain the problems from the horsehead geometry discussed above and add another compounding effect. As stated above, the induced torque from the fixed mounting point changes depending upon the stroke position (i.e., the walking beam angle). However, with crank mounted counter-weights, the induced CBE varies with the crank angle. Gravity works vertically through the center of gravity of the weights. Therefore the resulting CBE torque is at a maximum when the weights are horizontal, typically in the middle of the stroke. However the CBE goes to zero as the weights becomes vertical at the top and bottom of the stroke. Therefore, gear boxes for pumping units are typically sized one or two sizes larger than would otherwise be required.

Various attempts to solve this problem have been attempted. For example, U.S. Pat. No. 4,321,837 (Grigsby) discloses a system that uses additional moving crank mounted weights. This solution moves the zero point of CBE to a different crank angle which does not solve the wide variation in CBE. However, auxiliary weights rotating around a rotating crank arm also induce a costly complexity that has not proven cost effective.

As another potential solution to the problem, air balanced walking beam pumping units have been deployed. These units utilize the compression of a trapped gas, normally air, within a cylinder, to induce a CBE. The cylinders are typically installed on the horse head side of the walking beam. However, because the cylinder is attached to the walking beam at a fixed point, these units nevertheless share the geometry problems of units utilizing beam mounted counter-weights. The forces from the walking beam are applied to a fixed point while the effective length of the walking beam is constantly changing. Therefore the application of an ideal CBE does not match the tongue from the load.

In addition the pressure in the air cylinder is constantly changing as the cylinder expands or compresses the trapped air. These pressure swings can induce significant imbalance problems, which are attempted to be solved by eliminating pressure swings by venting air during compression and injecting compressed air during expansion. However, in operation, these units are generally not capable of producing a constant force CBE. In addition to these control problems, the air balanced units have proven very costly to operate. Operating costs and energy usage is much higher than for units utilizing mounted weights.

The above problems are based upon the loading induced at the polished rod by the pump actuation string. Another problem associated with actuation string loading is where insufficient rod load is realized at the subsurface pump to efficiently operate the pump because the actuation string is buckling. This problem is typically observed in wells which are highly deviated. In these installations, frictional loads induced on the actuation string in the deviated sections of the well may cause the actuation string to buckle and so reduce the rod weight realized at the subsurface pump that the plunger of the subsurface pump may not fully stroke within its barrel. In addition this buckling causes premature rod and tubing failures.

SUMMARY OF THE DISCLOSURE

Embodiments of the disclosed invention provide solutions to the problems identified above. In accordance with one embodiment of the present invention, an apparatus and method are provided which introduce a subsurface or downhole counter balance effect (DH-CBE) as opposed to the currently known surface applied CBE. Embodiments of the invention reduce polished rod load before it reaches the surface pumping unit. This DH-CBE is achieved by introducing an apparatus which utilizes a pressure differential between the fluid column inside the production tubing and pressure outside of the tubing. This pressure difference is applied to opposing cylinders of different sizes. The resulting force is applied to the rod string. The direction of the force is controlled by the relative positions of the opposing cylinders. If the desire is to create a DH-CBE to reduce loading in the polished rod, the differential pressure is applied to the larger diameter cylinder in an upward direction. On the other hand, if the desire is to increase rod weight at the pump, the differential pressure is applied to the larger diameter cylinder in a downward direction.

Because embodiments of the present invention reduce polished rod loading, pumping units may be more efficiently sized for a particular well, i.e., allowing a smaller sized unit to produce the same volume of fluid. Embodiments of the present invention allow the deployment of larger downhole pumps and heavier rods. Thus, embodiments of the present invention allow sucker rod pumping systems to produce new reservoirs currently out of reach for rod pumps. Moreover, for extremely deep wells, multiple DH-CBE devices might be stacked such that rod loads could be reduced or eliminated in wells of almost any depth.

DETAILED DESCRIPTION OF THE EMBODIMENTS

Figure 1:
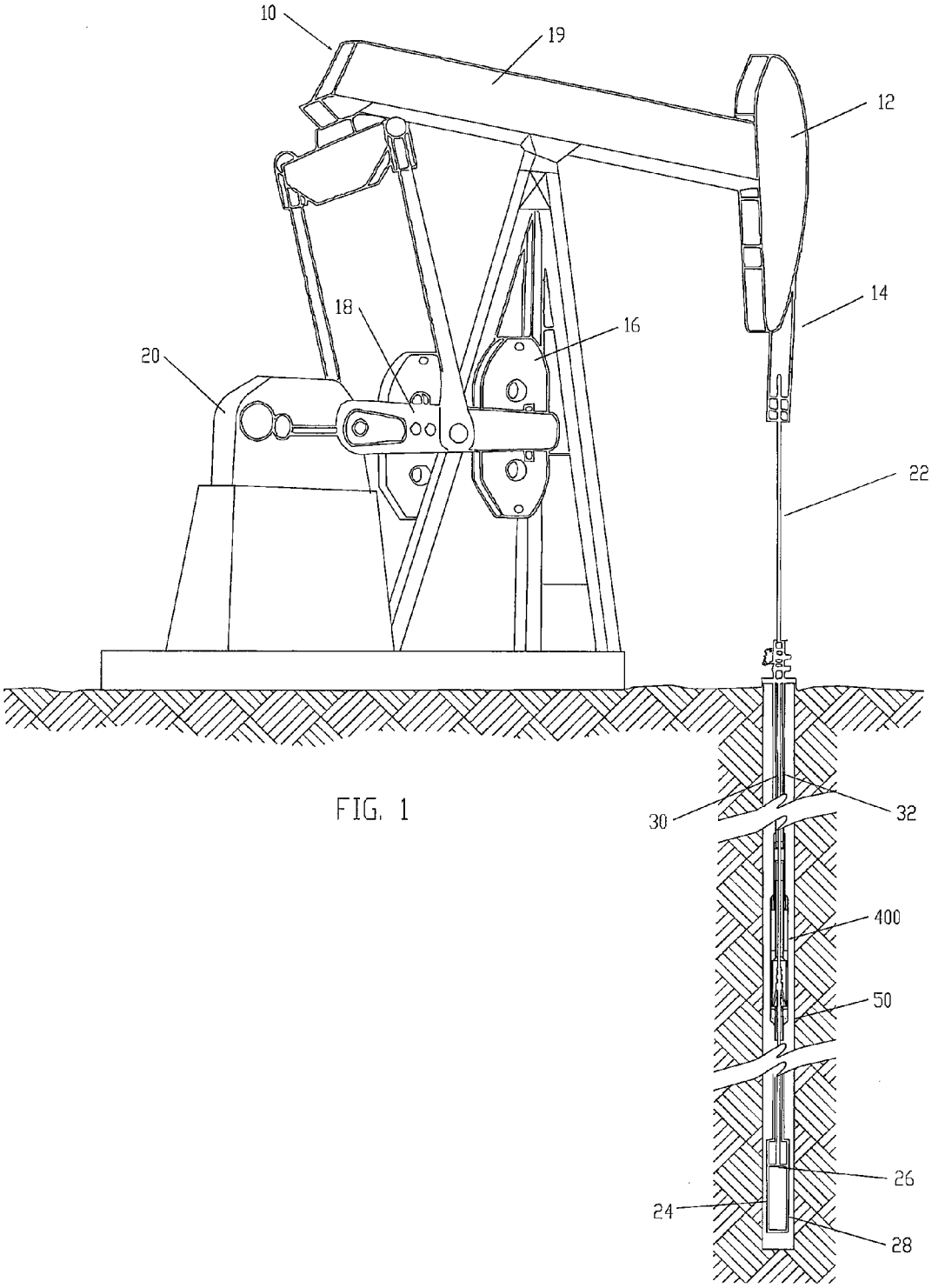
FIG. 1 schematically shows an embodiment of the DH-CBE apparatus utilized with a rod pumped well and a walking beam pumping unit.

Referring now to the figures, FIG. 1 shows one embodiment of a downhole counter-balance effect unit ("DH-CBE unit") 400 utilized with a conventional pumping unit 10. As shown in FIG. 1, pumping unit 10 has a horses head 12 to which a bridle 14 is attached. Pumping unit 10 is of the type which utilizes counterbalance weights 16 attached to crank arms 18 which are connected to gearbox 20 and walking beam 19. However, it is to be appreciated that embodiments of the present invention may be utilized with other types of surface pumping units, including beam balance pumping units, long stroke tower units, units utilizing coiled tubing or rods for pump actuation, units which rotate an actuation string for operating a progressive cavity pump, etc. It is also to be appreciated that the invention will also have utility in domestic water wells and natural gas dewatering wells. For purposes of this application, the term "downwardly" is used with reference to the direction of the subsurface pump, even though in a highly deviated well the subsurface pump may not necessarily be located in a downward position with respect to some locations in the wellbore. Likewise, the term "upwardly" means oriented toward the ground surface. It is also to be appreciated that while most surface pumping units are located on the ground surface, such units may also be contained within cellars below the ground surface, mounted inside the casing, or mounted upon pedestals, piers, offshore platforms, etc. Thus the term "ground surface" when used in this application refers to the surface upon which the surface pumping unit is disposed, and not necessarily the actual ground.

A typical oil well configuration has a wellhead from which a casing string 50 is suspended and cemented in place within a borehole. The casing 50 typically, but not necessarily, extends downwardly to a producing reservoir. A producing reservoir may initially have sufficient pressure to overcome the hydrostatic pressure such that fluid flows through tubing to the surface. However, as reservoir energy is depleted, it is often necessary to utilize some means of "artificial lift" to raise the fluid to the surface. When artificial lift is used for producing the fluid, flow of fluid into the well bore is usually increased if the fluid level inside the wellbore is kept at a minimum because of reduced backpressure against the producing reservoir. For this reason, it is usually preferred to maintain a producing rate with the artificial lift system which maintains the fluid level as close to the pump depth as possible. Thus, in the preferred situation, a full column of fluid is maintained in the tubing, while a minimal fluid column is maintained in the tubing-casing annulus. The present invention takes advantage of the pressure differential between the pressure imposed at a given depth inside of the tubing as compared to the pressure in the tubing-casing annulus at the same depth as discussed in greater detail below.

Pumping unit 10 reciprocates polished rod 22 which is suspended from bridle 14. Polished rod 22 is connected to a plurality of sucker rods 30 or other pump actuation string. Sucker rods (or "sucker rod string") 30 are connected together in an end-to-end configuration and extend down to subsurface pump 24. Sucker rods 30 are run inside tubing joints (or "tubing string") 32 which are also connected together in an end-to-end configuration. Different varieties of subsurface pumps 24 may be utilized. One variety, known as an "insert pump" is installed as a complete unit and is locked into the bottom joint of tubing 32. Another variety of pump, known as a "tubing pump," has its barrel attached to the bottom joint of tubing 32 while the plunger is lowered into the well on the sucker rods 30. The present invention may be utilized with either kind of these subsurface pumps.

Subsurface pump 24 has a plunger 26 which is reciprocated within the pump barrel 28. During the upstroke the plunger 26 lifts the fluid column into tubing string 32 which simultaneously pulls fluid into barrel 24 from the reservoir. Subsurface pump 24 utilizes valves which, on the upstroke, close in order to prevent backflow through plunger 24. On the downstroke, a valve closes preventing backflow of fluid out of the pump barrel 28, while another valve opens allowing the plunger 26 to drop through fluid in the barrel until the bottom of the stroke is reached.

Figure 2:
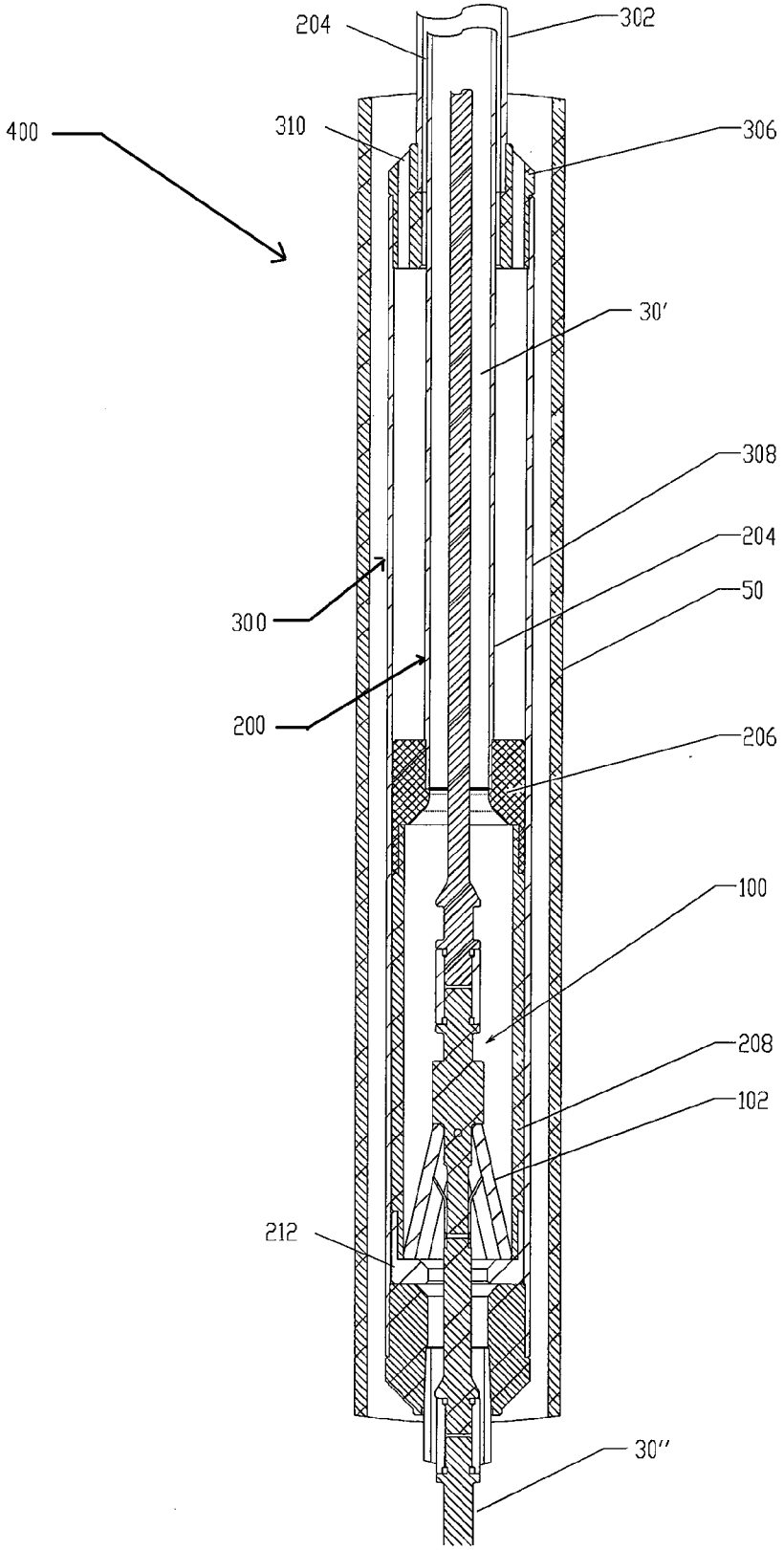
FIG. 2 shows a sectioned and partial view of an embodiment of the DH-CBE apparatus.
Figure 6:
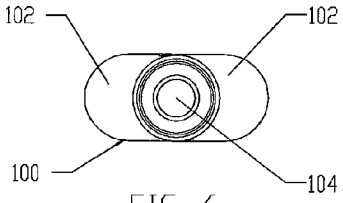
FIG. 6 shows a top view of the landing/locking assembly of FIG. 3 in the open position.
Figure 5:
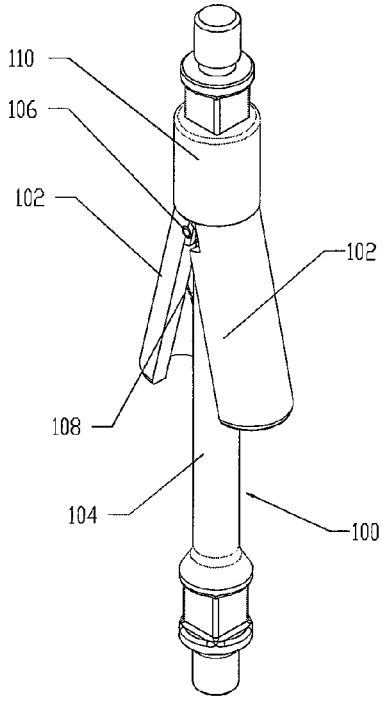
FIG. 5 shows a perspective view of the landing/locking assembly of FIG. 3 in an opened position.

As shown in FIG. 2, DH-CBE unit 400 comprises three major components—a landing assembly 100, an inner assembly 200, and an outer assembly 300. Landing assembly 100 is made up within the sucker rod string 30, with a portion of the sucker rod string 30' above the landing assembly, and another portion of the sucker rod string 30" suspended below the landing assembly, with the plunger 26 of the subsurface pump 24 attached to this lower portion of the rod string 30". Inner assembly 200 is disposed within outer assembly 300, with the two components installed as unit, with the outer assembly made up within the tubing string 32, with a portion of the tubing string 32' above the outer assembly and another portion of the tubing string 32" below the outer assembly.

The landing assembly 100 rests upon but will not pass through the inner assembly 200, and is lifted with the inner assembly on the upstroke by action of the net upward force acting on the inner assembly, such inner assembly 200 reciprocates within outer assembly 300 as the rod string 30 reciprocates. The length of the sucker rod string 30' above landing assembly 100 is such that the inner assembly 200 will reciprocate within outer assembly 300 without the inner assembly 200 impacting either end of outer assembly 300.

Figure 3:
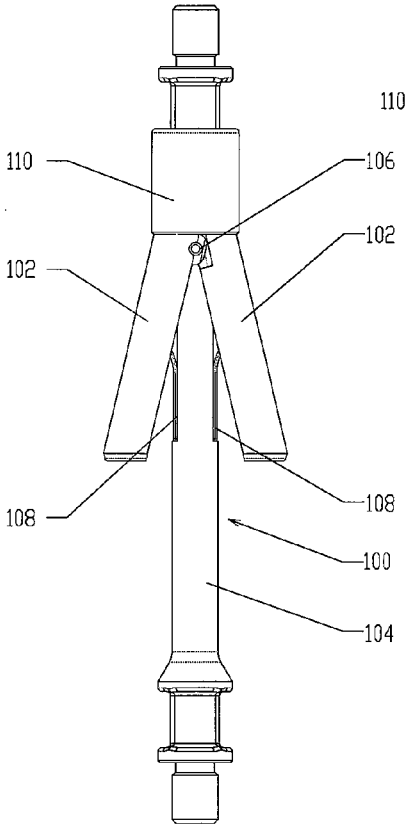
FIG. 3 shows a side view of embodiment of a landing/locking assembly which is utilized in the DH-CBE apparatus.
Figure 4:
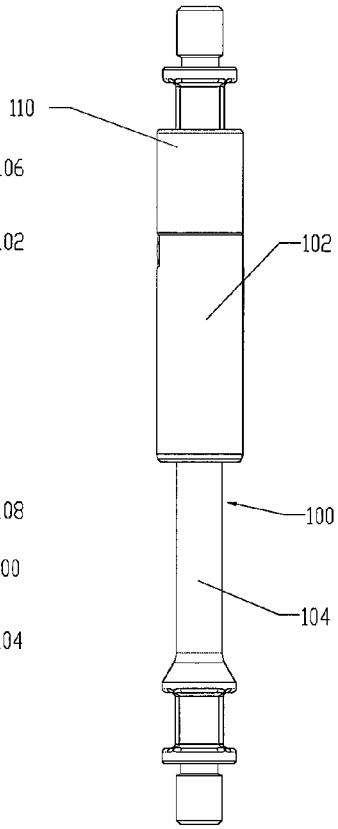
FIG. 4 shows a side view of the landing/locking assembly of FIG. 3 in a closed position utilized for installation.

As shown in FIGS. 3 through 6, the landing assembly 100 has a plurality of arms 102 which are attached to a body 104 with a pin 106. Arms 102 are attached to body 104 in such a manner which allows the arms 102 to movably swing into an open or closed position. A spring 108 is disposed between the body 104 and arms 102 such that the arms are pushed into an open position. The outside diameter of the landing assembly 100, in the closed position, as shown in FIG. 4, is small enough to allow the landing assembly 100 to pass through the inside diameter of tubing 30' and enter the inner assembly 200. The outside diameter of the landing assembly 100, in the open position is sufficiently large, as shown in FIG. 3, to prohibit it from inadvertently exiting inner assembly 200. Body 104 should be constructed of materials consistent with sucker rod 30 load capacities. Arms 102 are constructed from materials with sufficient strength to carry the DH-CBE loads. The landing assembly 100 may utilize other latching mechanisms known in the art for locking into and, when desired, releasing from the inner assembly 200.

In one embodiment of the landing assembly 100, there are holes at the top of each arm 102 which are 180 degrees apart and a corresponding hole through body 104. Pin 106 passes through the four holes in the arms 102 and through the body 104 such that the pin forms a hinge at the top of each arm, and there is a friction interference fit with one arm and the holes in the other arm and the body are oversized in order to insure the mobility of the arms. In this embodiment of landing assembly 100, loads are transferred from arms 102 to body 104 because the tops of the arms are trapped against body 102 and an integral shoulder 110 in the body. It is to be appreciated that the hydraulic forces being applied to the landing assembly will be pushing the inner assembly 200 upward, rather than the inner assembly being pulled upward. In the event that the up stroke speed is faster than the rise rate of the inner assembly 200, the landing assembly may be alternatively latched or locked to components of the inner assembly 200.

Figure 7:
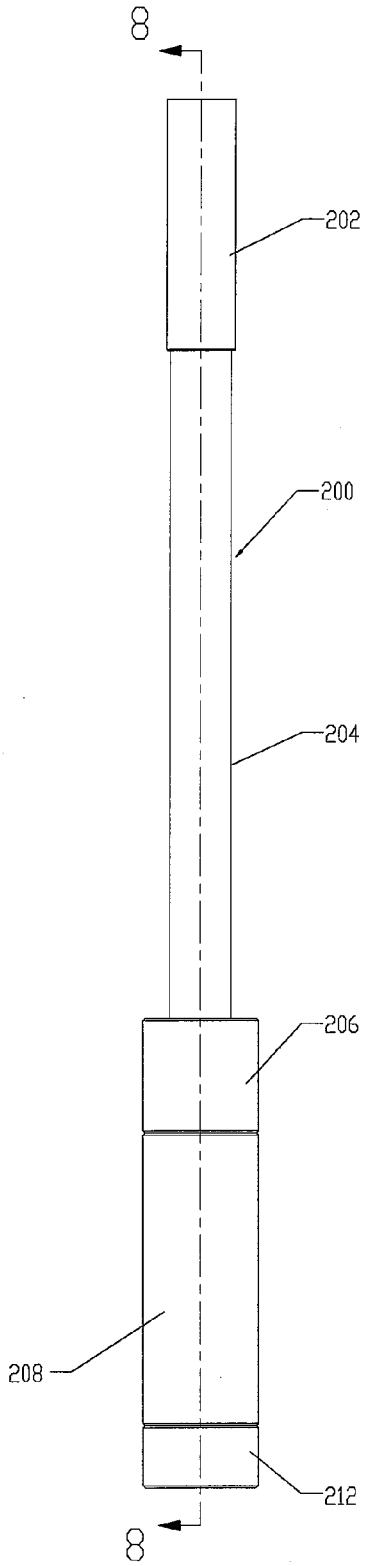
FIG. 7 shows an embodiment of the inner conduit which may be utilized in embodiments of the present invention.
Figure 8:
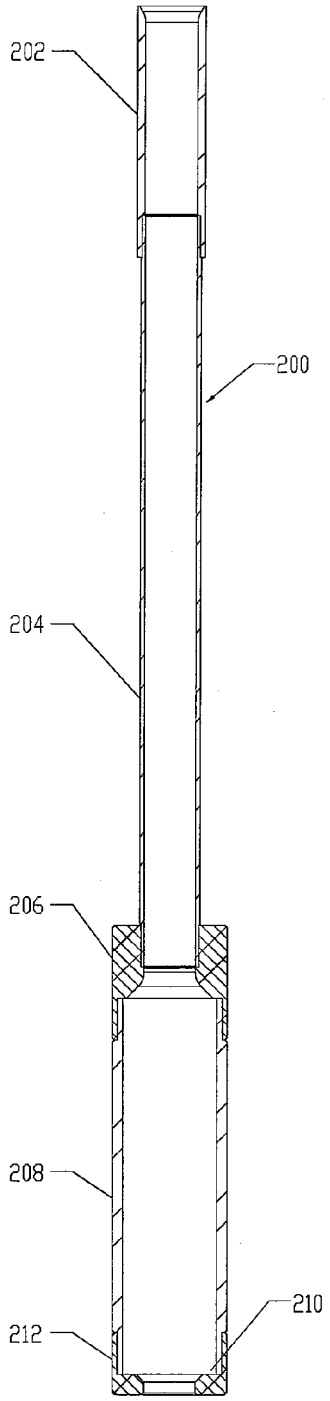
FIG. 8 shows a sectioned view of the inner conduit of FIG. 7 along line 8-8.
Figure 9:
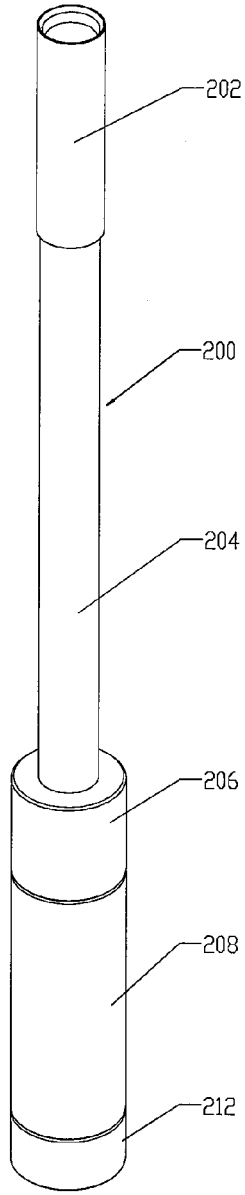
FIG. 9 shows a perspective view of the inner conduit of FIG. 7.

FIGS. 7 through 9 depict an embodiment of the inner assembly 200. In the depicted embodiment, the inner assembly 200 comprises an upper plunger 202 which is attached to a tube 204, an upper connector 206, a lower plunger 208, and a lower connector 212, which has an upwardly oriented face which comprises landing plate 210. Inner assembly 200 comprises an axial opening extending through the entire assembly. Upper plunger 202 moves relative to a sealing surface within the interior of outer assembly 300. Therefore the outside diameter of tube 204 is normally smaller than the diameter of upper plunger 202. This feature protects the adjacent sealing surfaces of the interior of outer assembly 300 from damage associated with movement of tube 204. Tube 204 is attached to upper connector 206. Upper connector 206 is attached to lower plunger 208. Lower plunger 208 terminates with lower connector 212, which contains landing plate 210. For embodiments of the invention which are utilized to reduce loading at the polished rod 22, the outside diameter of lower plunger 208 must be larger than the outside diameter of upper plunger 202. The internal diameters of upper plunger 202, tube 204, upper connector 206, lower plunger 208, and lower connector 212 are of sufficient size to allow the subsurface pump 24 and rods 30" to pass through. Best practices would normally have these internal diameters be equal to or greater than the internal diameter of tubing 32. This would insure that fluid flow through inner assembly 200 would be similar to that of tubing 32. Upper plunger 202 and lower plunger 208 can be constructed from standard oilfield subsurface pump plungers, while tube 204 may be fabricated from standard oilfield tubing.

Figure 10:
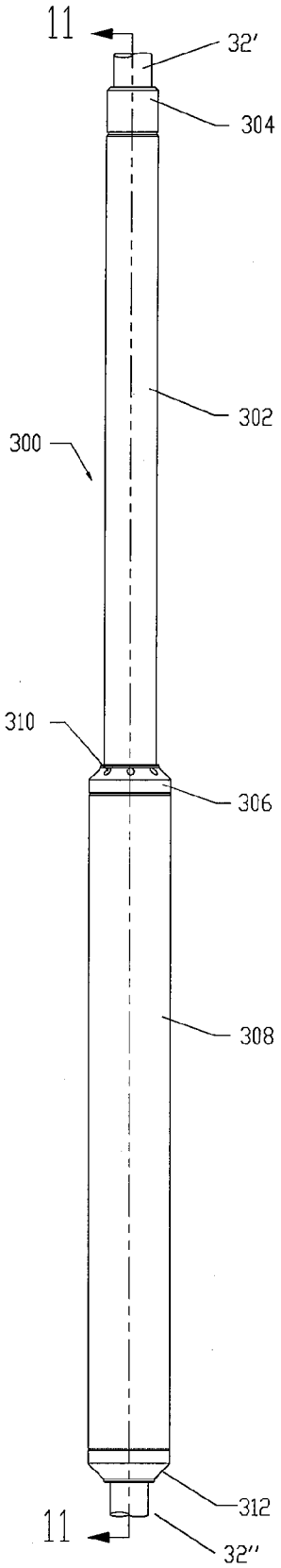
FIG. 10 shows an embodiment of an outer housing which may be utilized in embodiments of the present invention.
Figure 11:
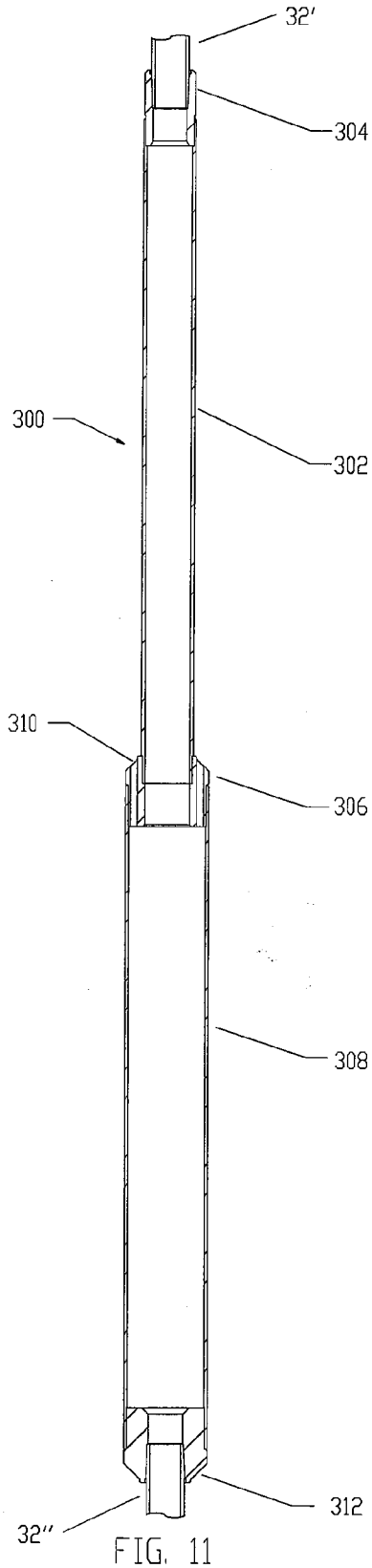
FIG. 11 shows a sectioned view of the outer housing of FIG. 10 along line 11-11.

As shown in FIGS. 10 through 11, the outer housing 300 is constructed with an upper barrel 302 and a lower barrel 308. Upper barrel 302 is constructed to be a matched set with plunger 202 above. The same is true with lower barrel 308 and lower plunger 208. An upper connector 304 attached to the upper end of upper barrel 302 comprises internal threads which allow tubing 32' to attach to upper barrel 302. Upper barrel 302 is connected to lower barrel 308 by an intermediate connector 306. Intermediate connector 306 has one or more ports 310. Ports 310 provide a fluid communication means between the interior and the exterior of the tubing 32 which, in the depicted embodiment, is a fluid flow path from the interior of outer assembly 300 to its exterior. A lower connector 312 attaches lower barrel 308 to tubing 32". Upper connector 304, upper barrel 302, intermediate connector 306, lower barrel 308 and lower connector 312 can all be constructed from methods currently used for sucker rod pumps.

Figure 12:
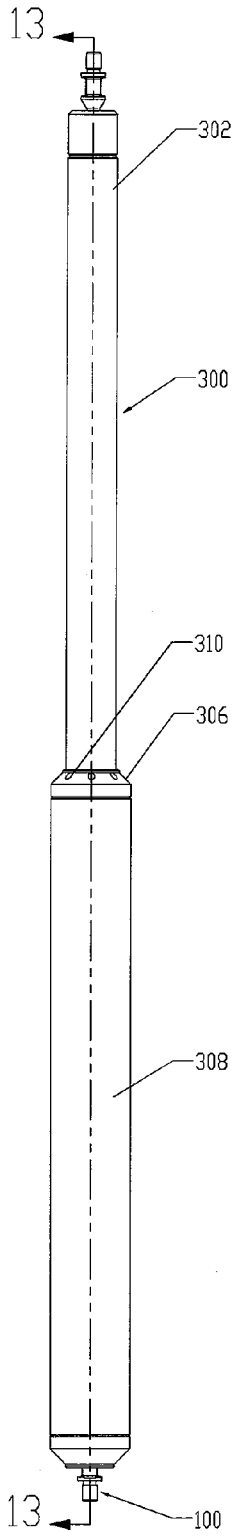
FIG. 12 shows an embodiment of the DH-CBE apparatus.
Figure 13:
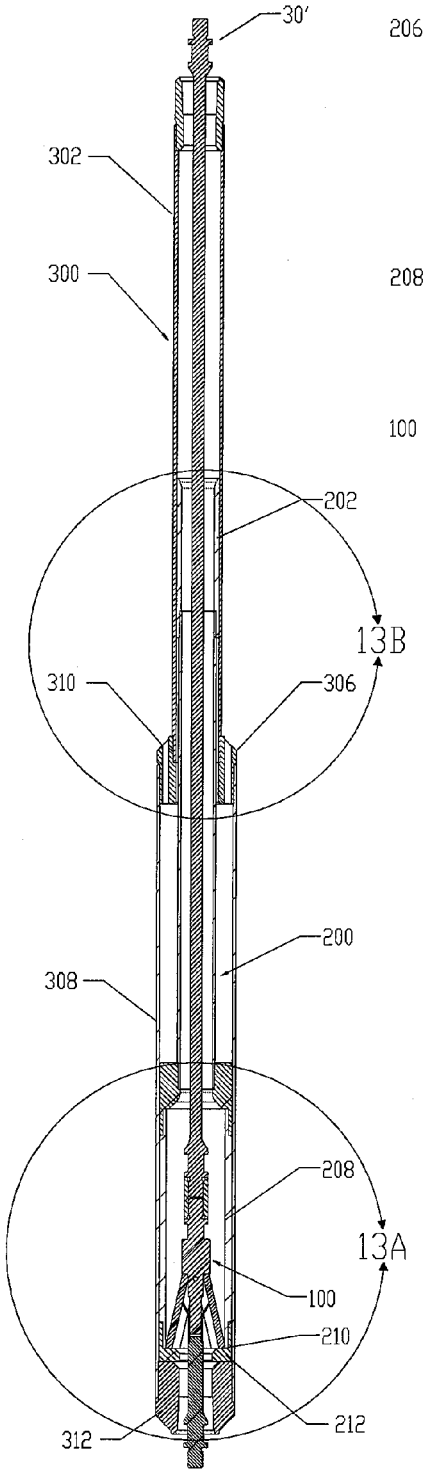
FIG. 13 shows a sectioned view of the DH-CBE apparatus of FIG. 12 along line 13-13.
Figure 13A:
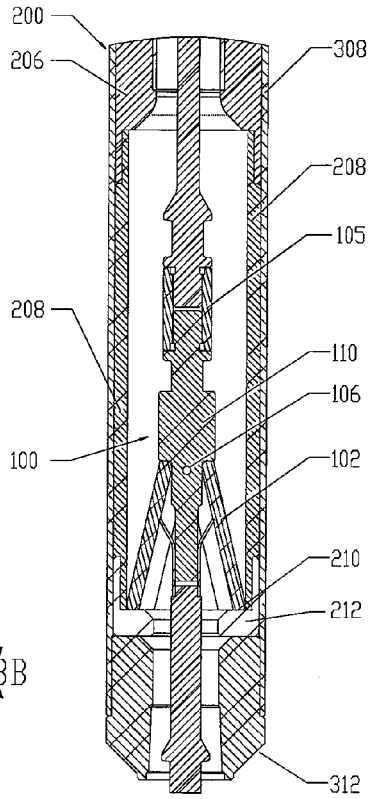
FIG. 13A shows a detailed view of the landing/locking assembly, showing it landed within the inner conduit.
Figure 14:
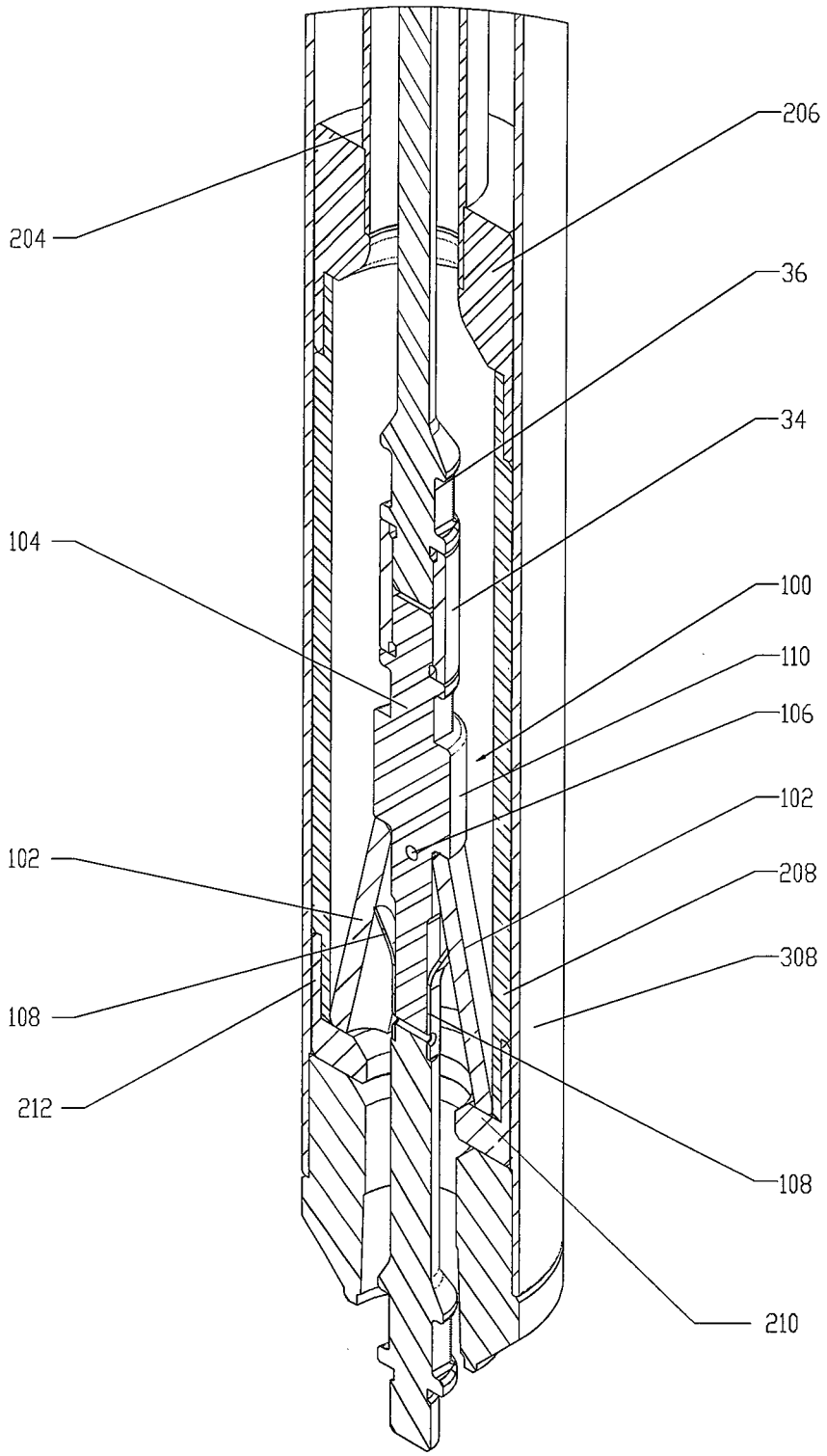
FIG. 14 shows a sectioned view of the landing/locking assembly, inner conduit, and outer housing.

FIGS. 12 and 13 depict an assembled embodiment of the DH-CBE unit 400, showing the relative positions of the landing assembly 100, inner assembly 200, and outer assembly 300. As shown in greater detail in FIG. 13A, the arms 102 of landing assembly 100 are extended and placed against landing plate 210. The body 104 of landing assembly 100 is connected on its upwardly facing end to rods 30' and to rods 30" on its downwardly facing end, which may require the use of rod couplings 34 and pony rods 36 as shown in greater detail in FIG. 14. Lower barrel 308 should be of sufficient length to insure that upper connector 206 will not impact intermediate connector 306 nor lower connector 212 impact lower connector 312 during normal reciprocation of pumping unit 10. Tube 204 should be configured to insure that the upper plunger 202 remains inside upper barrel 302 when lower connector 212 is in contact with lower connector 312. Upper barrel 302 should be of sufficient length to insure that upper plunger 202 remains inside upper barrel 302 when upper connector 206 is in contact with intermediate connector 306. There are a number of possible combinations of materials and fit for matching these plungers and barrels. These combinations are well documented in their use as downhole pumps.

Figure 13B:
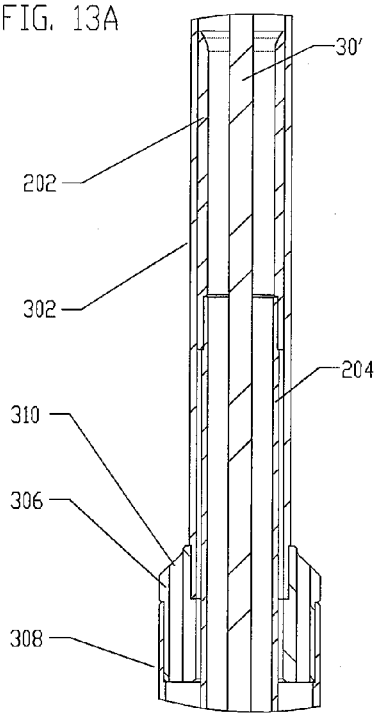
FIG. 13B shows a detailed view of a fluid communication means between the interior and the exterior of the tubing.

As shown in greater detail in FIG. 13B, the ports 310 provide a fluid communication means between the interior and the exterior of intermediate connector 306. Intermediate connector 306 connects upper barrel 302 to lower barrel 308. In that the corresponding upper plunger 202 and lower plunger 208 form seals, fluid does not drain out of tubing string 32. However the space inside outer assembly 300, outside inner assembly 200, above lower plunger 208, and below upper plunger 202 operates at the pressure exterior to intermediate connector 306.

The manner of installation involves placing the DH-CBE unit 400 at a predetermined depth within the well. Operation of the well thereafter is similar to other counter balancing methods. The pumping unit will perform in normal manner but at a reduced load. The installation process is consistent with current oilfield practices. Inner assembly 200 and outer assembly 300 are typically combined before arriving to the well. The lower portion of the tubing string 32" is installed in the well, which may include a barrel for a tubing liner pump, or a pump shoe if an insert pump is to be utilized as the subsurface pump 24. Outer assembly 300 is then made up into the tubing string 32 with the upper portion of the tubing string 32' attached to upper connector 304 of the outer assembly 300. Sufficient tubing 32' is utilized to place subsurface pump 24 and outer assembly 300 at the predetermined depths, and the tubing landed within the tubing hanger of the wellhead.

Following the landing of the tubing string 32, either an insert subsurface pump 24 or pump plunger are made up at the end of rod string 30 and run into the tubing. Once the lower portion 30" of the rod string has been installed, landing assembly 100 is made up into the rod string, followed by the upper portion 30' of the rod string, with sufficient rods installed to properly space the landing assembly 100 inside the inner assembly 200. The arms 102 of landing assembly 100 are placed in the closed position when run into tubing string 32. The spacing should be such that lower connector 212 of the inner assembly 200 does not impact lower connector 312. Known methods for determining rod and tubing stretch should be used to establish proper spacing. The arms 102 will open as the landing assembly 100 enters inside lower plunger 308. Landing assembly 100 will not pass through landing plate 210 with arms 102 in the open position. When it is desired to remove the landing assembly 100, withdrawing the assembly from the lower plunger 208 will push the arms 102 into the closed position, where the arms will remain until the landing assembly 100 is withdrawn from the well. It is recommended that the tubing string 32 be filled with fluid prior to operating pumping unit 10. This will lift the inner assembly 200 up to the landing assembly 100 and induce the counterbalancing forces.

Rod pump lift systems are typically configured to keep the rods in tension. These systems would include reciprocating rod pump systems and rotating progressive cavity pump systems. The DH-CBE outer assembly 300 should be sized and placed such that the upward force generated upon the lower plunger 208 does not exceed the weight of the rod string 30 and subsurface pump 24. The dynamic effects of reciprocating the rod string 30 should be included. The minimum polished rod load can be determined from a dynamometer or one of the commonly used pumping unit loading predictive computer programs. Minimum loads at the inner assembly 200 can be predicted from the polished rod predictions, which is a common oilfield practice. The DH-CBE outer assembly 300 would, in one embodiment, be sized to eliminate all but 500 lbs of the minimum load. The surface pumping unit CBE would be used to offset the remaining 500 lbs of rods and one half the fluid load.

Operating and management of the pumping system should then be the similar to before the use of the DH-CBE.

Theoretical Explanation of the DH-CBE Embodiment

Counter balancing forces are derived from the applying the pressure of the hydraulic head inside the tubing 32 to the cross-sectional area difference between the upper plunger 202 and the lower plunger 208. During pump operation the tubing string 32 is full of produced fluid to the surface. The pressure inside the tubing string 32 at the depth of the inner assembly 200 is equal to the flowline surface pressure plus the hydraulic head generated by the fluid gradient. Assuming the fluid level is maintained at a depth below the DH-CBE unit 400, the pressure in the tubing-casing annulus is the casing collection pressure plus the hydraulic head generated by the gas gradient. For example, assuming a casing collection pressure of 2 PSI and tubing discharge pressure of 80 PSI, a pressure differential of 300 psi may exist between the inside and outside of the tubing at a depth of 500 feet. With the various cross-sectional areas utilized for a upper plunger 202 and lower plunger 208, an upward force of approximately 5,000 lbs will be generated, which is the resulting DH-CBE. This upward force is derived from the applying the 300 psi across the larger lower plunger 208 and subtracting the force resulting from applying the 300 psi against the smaller upper plunger 202, which acts downward. The port(s) 310 maintain the lower pressure on the opposite sides of upper plunger 202 and lower plunger 208. Port 310 also allows for the discharge of any fluids which may have leaked past upper plunger 202 or lower plunger 208. These fluids would travel down the outside of the tubing 32" and be picked up by the subsurface 24. DH-CBE forces can be increased by increasing the diameters of lower plunger 208 and lower barrel 308. Alternatively reducing the diameters of upper plunger 202 and barrel 302 will also increase CBE forces. CBE forces can also be increased by running the DH-CBE unit 400 deeper in to the well.

Other Applications for Embodiments of the Invention

Figure 15:
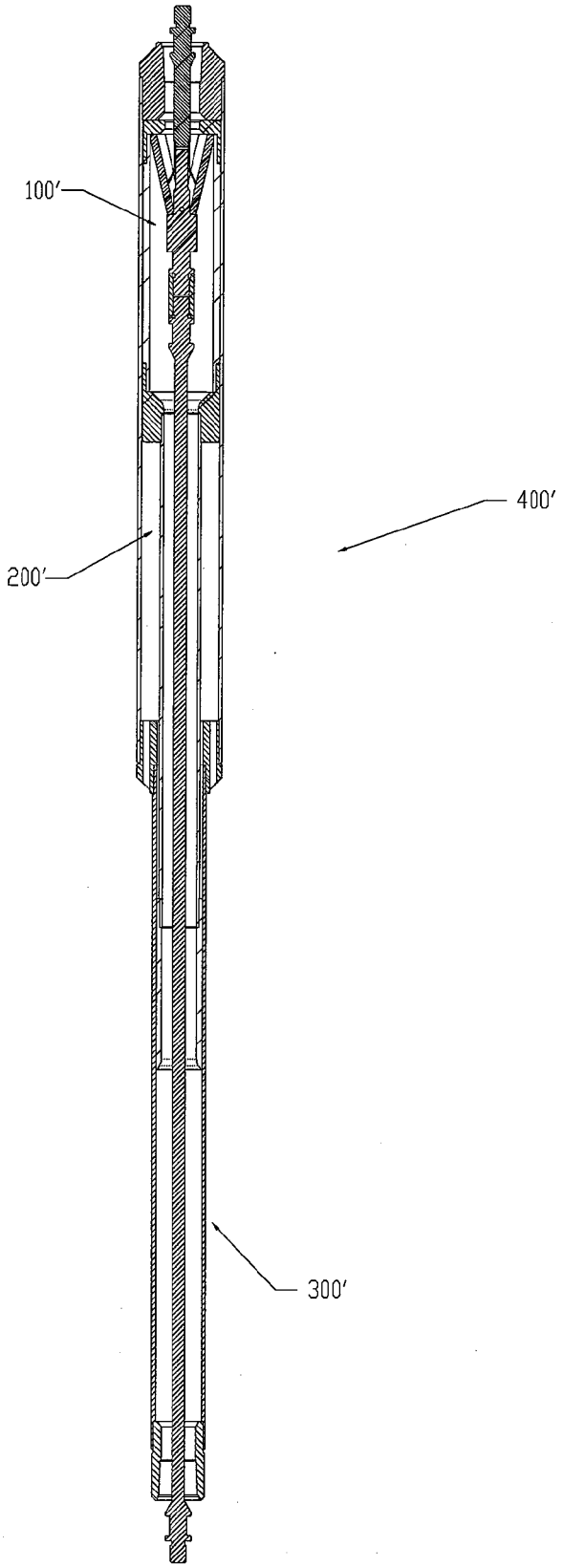
FIG. 15 shows an embodiment of the present invention which may be utilized to prevent rod buckling.

Because the present invention provides an apparatus and method for changing the loads realized within a subsurface pump actuation string, other applications have utility. One alternative embodiment of the invention utilizes a DH-CBE unit 400' oriented to induce a downward force in the rod string 30, as depicted in FIG. 15. In this application the DH-CBE unit 400' would typically be installed near the pump. The DH-CBE unit 400' may be used in wells which, for a variety of reasons, may have a slow rod fall. The slow rod fall limits the overall pumping rate which may be achieved because it limits the strokes per minute. Slow rod fall can occur in wells with heavy oils, highly deviated, or horizontal wells. In highly deviated and horizontal wells the rods lay against the tubing and the resulting drag slows the rod fall. Wells producing a high viscosity oil can have a similar problem because of the drag caused by the heavy oil. Normally, the operational speed of a pumping unit is limited such that the speed of the down stroke does not exceed the rod fall. Otherwise, the pumping unit and rods would be damaged. Because prime movers typically operate at constant speed, the upstroke velocity is matched to the down stroke and therefore limited as well.

The DH-CBE unit 400' depicted in FIG. 15 is generally the same as the unit 400 depicted in FIG. 13, except the unit 400' of FIG. 15 is upside down as compared to the unit 400 of FIG. 13. Unit 400' is typically placed in close proximity to the subsurface pump 24, such that unit 400' applies a force which pulls the rods 30 down into the well on the down stroke. This placement will reduce the likelihood of rod string compression (which induces buckling), which can cause rod failures. An alternative embodiment of unit 400' could include an integral subsurface pump, such that the plunger and barrel of the pump would also function as the lower plunger and barrel of the unit 400'.

As shown in FIG. 15, unit 400' comprises a landing assembly 100', an inner assembly 200', and an outer assembly 300'. The other components of the unit 400' correspond to the components of the DH-CBE unit 400 described above.

Other embodiments of the invention may be utilized with other types of artificial lift equipment. For example, an embodiment of the invention might be used with a reciprocating lift system which operates by both pulling the rods upward and pushing the rods downhole. Such a system would be used with a pumping unit other than the walking beam pumping unit 10, such as with a hydraulic pumping unit. In such case the landing assembly 100 and inner assembly 200 could be constructed such that the landing assembly 100 would lock into the inner assembly 200 utilizing latching or locking mechanisms known in the art, such as a mechanical hold down assembly commonly used with insert rod pumps. Locking the landing assembly into the inner assembly would allow the inner assembly to apply a force to both the up and down stroke of the rods. The downward pumping forces offer the potential of placing the DH-CBE unit into a full counterbalancing mode, i.e., the DH-CBE unit could be sized to supply the ideal CBE of one hundred percent of the rod load and one half the fluid load.

Another embodiment might include extending the upper sealing elements to the wellhead. This embodiment would have application for wells having large solids production. Additional joints of pipe would be added to extend tube 204 out of the wellhead. The outer surface of the top joint would have a finish similar to polished rod 22. Pumping unit 10 would then be attached directly to the top polished tube 204. Tube 204 would then replace the upper plunger 202, rods 30', and polished rod 22. A standard oilfield stuffing box could then be used to replace the upper barrel 302. Rods 30 would be hung directly upon inner assembly 200.

While the above is a description of various embodiments of the present invention, further modifications may be employed without departing from the spirit and scope of the present invention. Thus the scope of the invention should not be limited according to these factors, but according to the following appended claims.

I claim:

1. In a fluid producing well in which a subsurface pump is actuated by an actuation string extending to the subsurface pump, said pump lifting fluid from the subsurface to a higher elevation through a tubing string having an interior and an exterior, said fluid producing a hydrostatic pressure inside the tubing string, an apparatus for changing loading in the actuation string, the apparatus comprising:

a. an upper plunger slideably disposed inside an upper barrel, the upper plunger having a first axial opening extending through an upper interior;

b. a lower plunger slideably disposed inside a lower barrel, the lower barrel having an interior and an exterior, the lower plunger having a second axial opening extending therethrough, wherein the upper barrel and the lower barrel are connected together by an intermediate connector to comprise a tube member, the tube member made up as a component of the tubing string;

c. said lower barrel having a different cross-sectional area than said upper barrel;

d. a fluid communication means in the intermediate connector which allows fluid communication from the interior of the lower barrel to the exterior of the tubing string; and e. the actuation string extending through and below the upper plunger and the lower plunger to operate the subsurface pump which is set below the lower plunger.

2. The apparatus of claim 1 wherein the actuation string comprises one or more sucker rods.

3. The apparatus of claim 1 wherein the subsurface pump is actuated by reciprocation of the actuation string.

4. The apparatus of claim 1 wherein the subsurface pump is actuated by rotation of the actuation string.

5. The apparatus of claim 1 wherein the cross-sectional area of the lower barrel is larger than the cross-sectional area of the upper barrel.

6. The apparatus of claim 1 wherein the cross-sectional area of the lower barrel is smaller than the cross-sectional area of the upper barrel.

7. In a hydrocarbon producing well in which a subsurface pump is actuated by an actuation string extending to the subsurface pump, said actuation string disposed inside of a tubing string, said tubing string comprising an interior and an exterior, a method of changing the loading on the actuation string comprising the following steps:

a. installing the tubing string, wherein the tubing string comprises an a tube member comprising an upper barrel and a lower barrel, wherein the upper barrel and lower barrel each comprise an interior and are connected together by an intermediate connector said tubing string further comprising an inner conduit slidably disposed within the tube member, wherein the inner conduit comprises an upper plunger having an axial opening and a lower plunger having an axial opening, the upper plunger having a first diameter and the lower plunger having a second diameter, and the first diameter is different from the second diameter, said intermediate connector comprising a fluid communication means which allows fluid communication from the interior of the lower barrel to the exterior of the tubing string;

b. installing the actuation string inside the tubing string, wherein the actuation string comprises a landing assembly; and c. spacing out the actuation string such that the landing assembly lands within the inner conduit and travel of the upper plunger is confined to the upper barrel and travel of the lower plunger is confined to the lower barrel and such that the actuation string extends through and below the upper plunger and the lower plunger to operate the subsurface pump which is set below the lower plunger.

8. The method of claim 7 wherein the actuation string comprises one or more sucker rods.

9. The method of claim 7 wherein the first diameter is smaller than the second diameter.

10. The method of claim 7 wherein the first diameter is larger than the second diameter.

11. The method of claim 7 wherein the landing assembly is adapted to lock inside the inner conduit.

12. In a fluid producing well having a subsurface pump operated by a rod string, an apparatus for changing the loading on the rod string, the apparatus comprising:

a. a subsurface pump actuated by the rod string extending to the subsurface pump from the pumping unit;

b. a tubing string comprising an interior and an exterior and an outer assembly comprising an upper barrel and a lower barrel, said tubing string further comprising an inner conduit slidably disposed within the outer assembly, wherein the inner conduit comprises an upper plunger having an axial opening and a lower plunger having an axial opening, the upper plunger having a first diameter and the lower plunger having a second diameter, and the first diameter is different from the second diameter;

c. said rod string comprising a landing assembly adapted to land inside the inner conduit wherein, a portion of the rod string extends through the upper barrel and the lower barrel and a first portion of the rod string is above the landing assembly and a second portion of the rod string is below the landing assembly; and d. wherein said upper plunger is disposed within the upper barrel and the lower plunger is disposed within the lower barrel.

13. The apparatus of claim 12 wherein said outer assembly comprises a fluid communication means between the lower barrel and the exterior of the tubing.

14. The apparatus of claim 12 wherein the first diameter is smaller than the second diameter.

15. The apparatus of claim 12 wherein the first diameter is larger than the second diameter.

* * * * *